US005758238A

United States Patent [19]

Mordenga et al.

[11] Patent Number: 5,758,238

[45] Date of Patent: May 26, 1998

[54] AUGER CONFIGURATION FOR ELIMINATING AUGER MARK PRINT DEFECT

[75] Inventors: Samuel P. Mordenga, Rochester; Lam F. Wong, Fairport; Gerald T. Lioy, Rochester; Rhonda L. Staudt, Webster; Timothy G. Struczewski, Rochester; Gene S. Serafine, Henrietta; Justine M. Woods, Webster; Ronald A. Fraser, Rochester, all of N.Y.

[73] Assignee: Xerox Corporation, Stamford, Conn.

[21] Appl. No.: 753,455

[22] Filed: Nov. 25, 1996

[51] Int. Cl.[6] ..... G03G 15/08

[52] U.S. Cl. ..... 399/256; 366/322

[58] Field of Search ..... 399/254, 255, 399/256; 366/322, 324

[56] References Cited

U.S. PATENT DOCUMENTS 3,999,514 12/1976 Abbott et al. ..... 118/657

4,056,076 11/1977 Smith ..... 118/653

4,146,323 3/1979 Forward et al. ..... 355/3

4,274,362 6/1981 Beck et al. ..... 118/657

4,478,512 10/1984 Zoltner ..... 355/3

*Primary Examiner*—Joan Pendegrass

*Attorney, Agent, or Firm*—Lloyd F. Bean, II

[57] ABSTRACT

A development system for a reproduction machine includes a pair of augers which mix and transfer the developer mixture to a magnetic roll brush system. A supply auger having a length at least as great as said magnetic brush roll is positioned along a horizontal plane and adapted to transport developer material in a direction so as to supply said material to said magnetic brush roll. The auger has a first portion thereof having an irregular blade edge and wedge shaped paddles to eliminate auger mark print defects.

7 Claims, 6 Drawing Sheets

AUGER CONFIGURATION FOR ELIMINATING AUGER MARK PRINT DEFECT

BACKGROUND OF THE PRESENT INVENTION

The invention relates generally to an electrophotographic printing machine and, more particularly, to a development system which includes a dual auger assembly for mixing the developer.

Generally, an electrophotographic printing machine includes a photoconductive member which is charged to a substantially uniform potential to sensitive the surface thereof. The charged portion of the photoconductive member is exposed to a light image of an original document being reproduced. This records an electrostatic latent image on the photoconductive member corresponding to the informational areas contained within the original document. After the electrostatic latent image is formed on the photoconductive member, the image is developed by bringing a developer material into contact therewith. Generally, the developer material comprises toner particles adhering triboelectrically to carrier granules. The toner particles are attached to the latent image from the carrier granules to form a powder image on the photoconductive member which is subsequently transferred to a copy sheet. Finally, the copy sheet is heated to permanently affix the powder image thereto in image configuration.

As the toner particles are depleted from the developer material, it is necessary to dispense additional toner particles into the developer mixture. Then newly added toner is typically mixed in some manner with the denuded carrier particles and unused developer material. A common problem involving two component development relates to the degradation of two-component developer material, that is the mixture of carrier and toner, over the life of the printer or copier. One print quality problem results from the fact that, whereas the toner in the developer material is gradually consumed by being place on the photoreceptor and then onto a copy sheet. After successive prints the ratio of toner to carrier drifts from an optimal level. Further the frequency of print quality defects tend to increase with the length of service of a two component development system. Another print quality problem results from augers used to accomplish the mixing function of two-component developer material, Applicant have found auger has contributed to diagonal bands (auger mark print defects) being developed onto to prints.

Various prior art devices have been devised to accomplish the mixing function. A preferred system for accomplishing the crossmixing function is the use of a dual auger system to transport the toner in two directions and achieve a toner interchange between augers. Dual auger systems are disclosed, for example, in the following prior art documents. U.S. Pat. No. 4,274,362 to Beck et al. discloses magnetic brush mixing augers made of twisted strips of aluminum sheet metal with smooth axial edges. In a developing unit, the auger members are located in the sump portion of a developing pan where they circulate, distribute and intermix dry toner. A dispensing system evenly distributes regular amounts of toner while the copier is operable.

U.S. Pat. No. 4,056,076 to Smith, assigned to Xerox Corporation, discloses a crossmixing system for mixing and charging multicomponent developer in a circulating development system of an electrostatographic processor. A pair of parallel passive crossmixers are used as mixing devices and a single active crossmixer is used as a blending (triboelectric charging) device.

U.S. Pat. No. 4,146,323 to Forward et al., assigned to Xerox Corporation, discloses an auger for a development system comprised of an elongated twisted strip of sheet metal with helically contoured edges. As toner is dispensed, fresh toner is added to the developer from a toner dispenser directly above a crossmixer to keep the toner concentration at a high level.

U.S. Pat. No. 4,478,512 to Zoltner, assigned to Xerox Corporation, discloses a developer system in which a pair of augers mix newly dispensed toner with denuded carrier particles and returns the mixture into a developer sump.

U.S. Pat. No. 3,999,514 to Abbott et al. describes a supply and return auger system in which the augers are rotated at different flute and pitch related speeds which ensure equal flow through the auger.

U.S. Pat. No. 3,664,299 to Shaler et al. discloses still another dual auger mixing system.

However, even with the above teaching problems with augers efficiently mixing two component developer material while eliminating print quality problems such as auger mark print defects still remains.

SUMMARY OF THE INVENTION

Briefly, the present invention obviates the problems noted above by utilizing an auger for a development system wherein developer material is supplied to a rotating magnetic brush roll, the system including: a supply auger having a length at least as great as said magnetic brush roll, said auger positioned along a horizontal plane and adapted to transport developer material in a direction so as to supply said material to said magnetic brush roll, said auger having a first portion thereof having an irregular blade edge and wedge shaped paddles to eliminate auger mark print defects.

DESCRIPTION OF THE INVENTION

Figure 1:
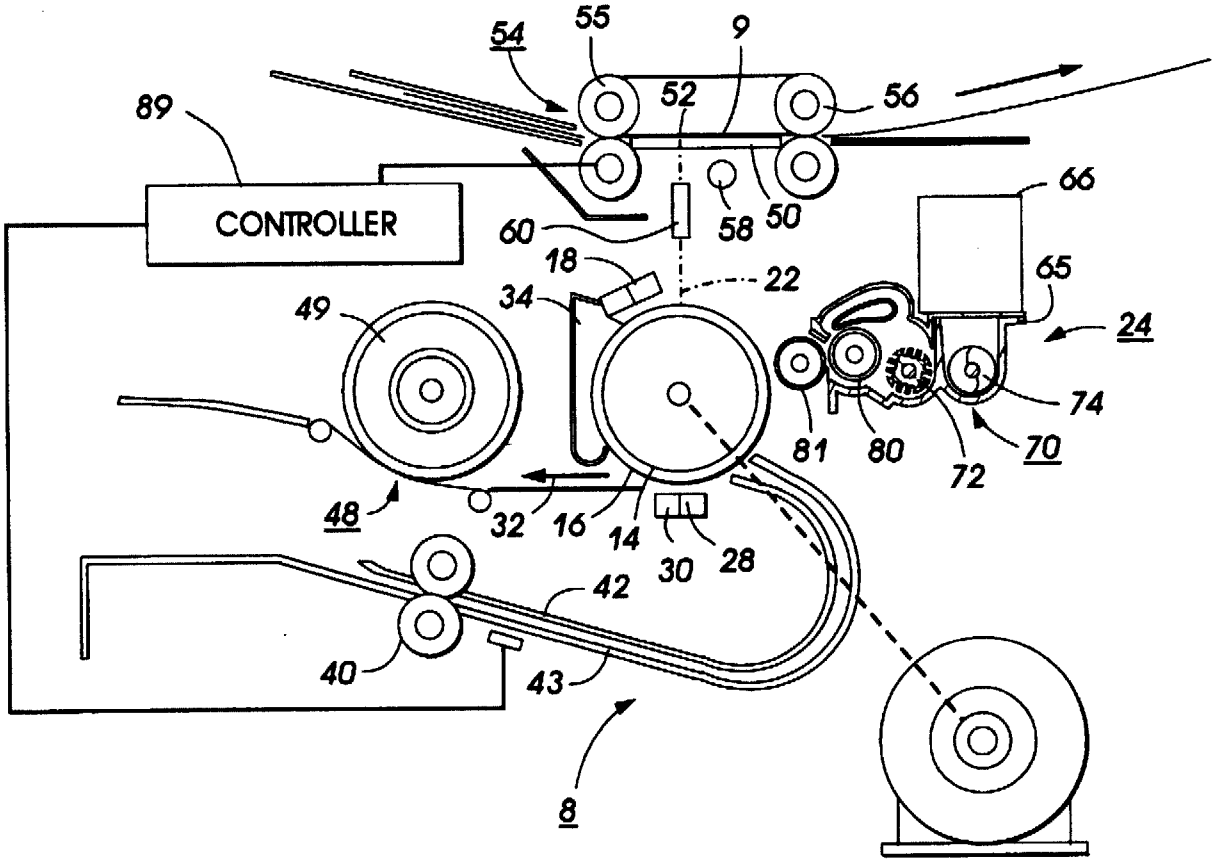
FIG. 1 is a side view, is section, of a xerographic reproduction machine incorporating the dual auger mixing assembly of the present invention.

Referring to FIG. 1 of the drawings, there is shown a xerographic type reproduction machine 8 incorporating the dual auger mixing assembly of the present invention, designated generally by the numeral 10. Machine 8 has a suitable frame (not shown) on which the machine xerographic components are operatively supported. Briefly, and as will be familiar to those skilled in the art, the machine xerographic components include a recording member, shown here in the form of a rotatable photoreceptor 14. In the exemplary arrangement shown, photoreceptor 14 comprises a drum having a photoconductive surface 16. Operatively disposed about the periphery of photoreceptor 14 are a charge corotron 18 for placing a uniform charge on the photoconductive surface 16 of photoreceptor 14; an exposure station 22 where the previously charged photoconductive surface 16 is exposed to image rays of a document 9 being copied or reproduced; development station 24 where the latent electrostatic image created on photoconductive surface 16 is developed by toner; and transfer detack corotrons 28 and 30 for assisting transfer of the developed image to a suitable copy substrate material such as a copy sheet 32 brought forward in timed relation with the developed image on photoconductive surface 16. Residual toner is removed from the drum surface at cleaning station 34.

Copy sheets 32 are brought forward to the transfer area by feed roll pair 40, sheet guides 42, 43 serving to guide the sheet through an approximately 180° turn prior to the transfer area. Following transfer, the sheet 32 is carried forward to a fusing station 48 where the toner image is fixed by fusing roll 49. After fusing, the copy sheet 32 is discharged to an output tray.

A transparent platen 50 supports the document 9 as the document is moved past a scan point 52 by a constant velocity type transport 54. As will be understood, scan point 52 is in effect a scan line extending across the width of platen 50 at a desired point along the platen where the document is scanned line by line as the document is moved along platen 50 by transport 54. Transport 54 has input and output document feed roll pairs 55, 56, respectively, on each side of scan point 52 for moving document 9 across platen 50 at a predetermined speed. Exposure lamp 58 is provided to illuminate a strip-like area of platen 50 at scan point 52. The image rays from the document line scanned are transmitted by a gradient index fiber lens array 60 to exposure station 22 to expose the photoconductive surface 16 of the moving photoreceptor 14.

Developer station 24 includes a developer housing 65 in which a toner dispensing cartridge 66 is rotatably mounted so as to dispense toner particles downward into a sump area occupied by the dual auger mixing assembly 70 of the present invention. Assembly 70 includes a pair of rotatably mounted augers 72, 74; further details of the construction and operation of assembly 70 are provided below.

Continuing with the description of the developing station 24, a donor roll 81 is disposed in predetermined operative relation to the photoconductive surface 16 of photoreceptor 14, the length of donor roll 81 being equal to or slightly greater than the width of photoconductive surface 16, with the axis of roll 81 parallel to the axis of photoreceptor 14. Magnetic roll 80 supplies toner to 25 donor roll 81. Magnetic roll 80 has a plurality of stationary magnet assemblies (not shown) disposed within a rotatable cylinder or sleeve. Rotation of sleeve carries the developer brush onto donor roll 81. Donor roll 81 has applied AC & DC electrical bias between the donor roll and photoconductive surface to develop the latent image.

The document image developed on the photoconductive surface 16 of photoreceptor 14 is transferred to copy sheet 32 as the copy sheet moves through the transfer area. Following transfer, the copy sheet 32 passes to fusing station 48 where the image is fixed.

As latent images are formed, and developer and toner depleted, fresh toner is dispensed as dispenser cartridge 66 rotates. Auger 74 continually mixes the fresh toner with the denuded carrier particles and existing developer. The system is thus constantly ensuring that freshly added toner is constantly being mixed into the existing developer.

Figure 2:
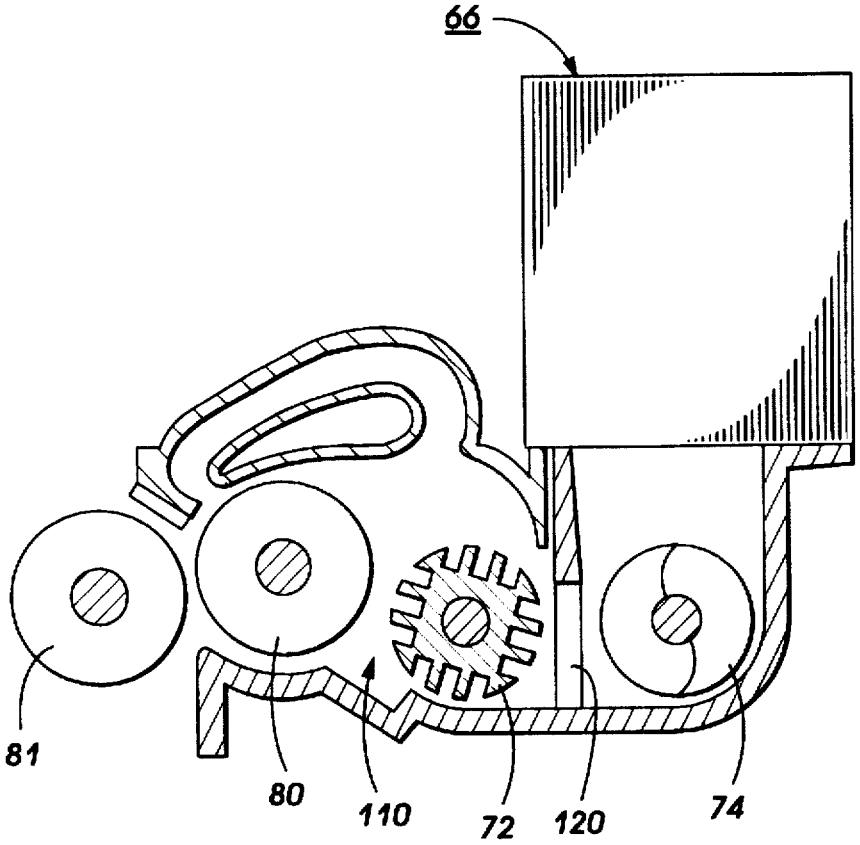
FIG. 2 is an enlarged side view of the developer assembly shown in FIG. 1.
Figure 3:
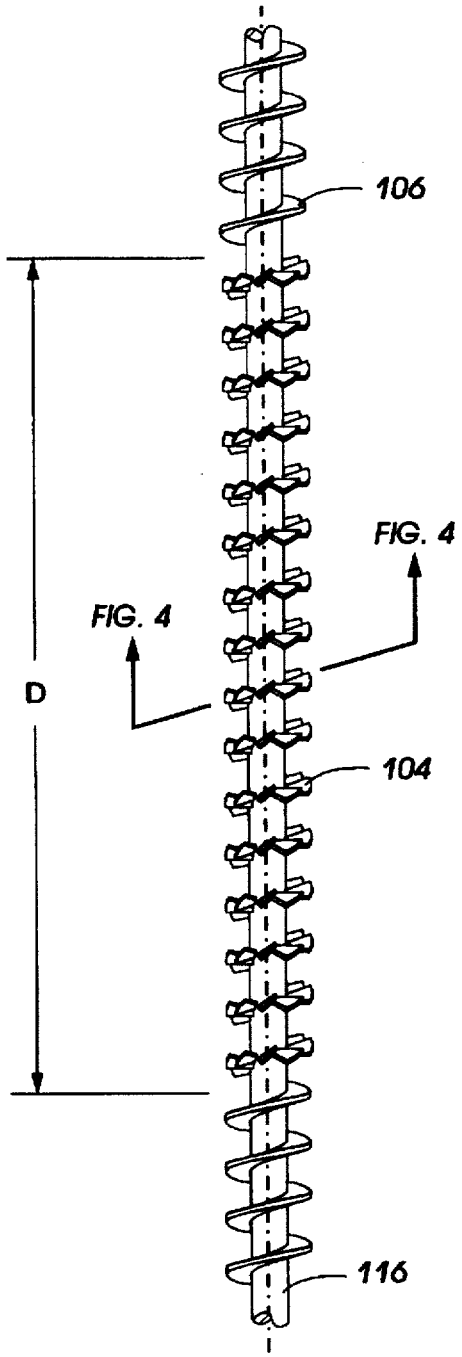
FIGS. 3–8 are auger embodiment incorporating principles of the present invention.
Figure 4:
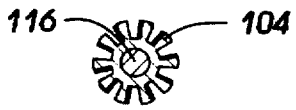
Figure 5:
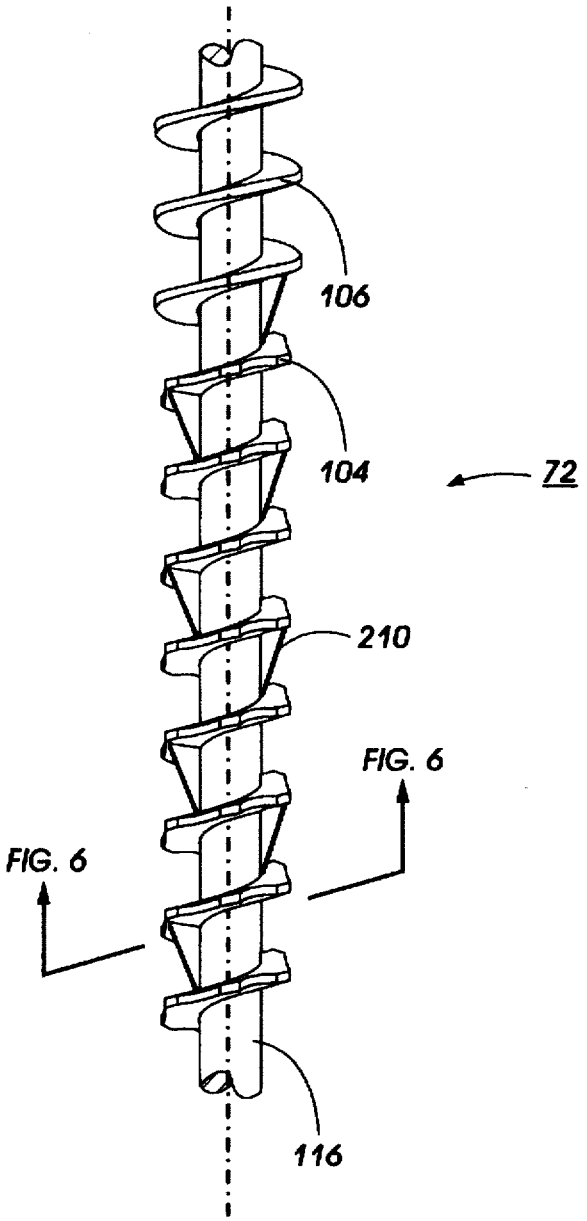
Figure 6:
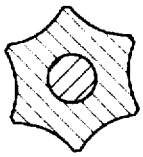
Figure 7:
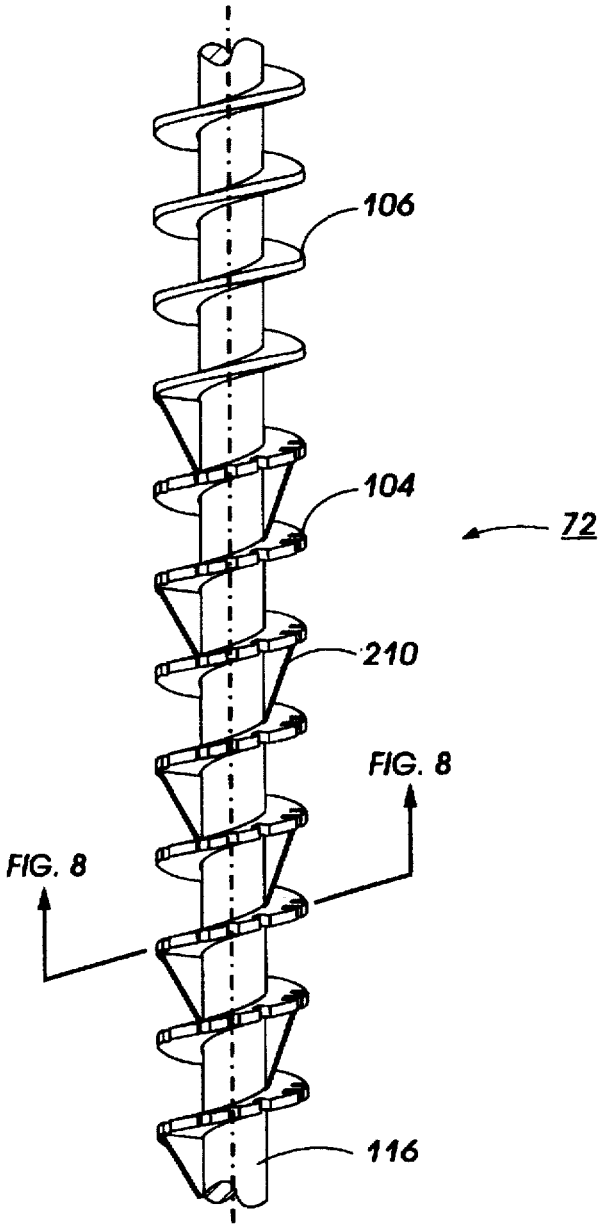
Figure 8:
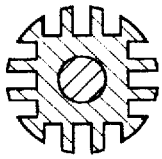

Turning now to FIG. 2, a more detailed description of the developer station 24, and particularly the auger mixing assembly 70. Auger 72 having blade segments 104 and 106 are mounted on horizontal shaft 116 which is driven by motor means (not shown) in a counterclockwise direction. As shown in FIG. 3, auger 72 includes irregular blade segments 104 extending a length "D" on central portion of shaft 116 and smooth blade segments 106 on the end portions of shaft 116. Supported adjacent auger 72 is a trough 110 extending the length of the auger. Auger 74, driven by appropriate motor means in a clockwise direction. Auger 74 with transfer opening 120 is positioned adjacent one end of auger 72 and receives developer from the auger. The developer is transferred from auger 72 to auger 74. Auger 74 then mixes the developer and carries it.

Figure 9:
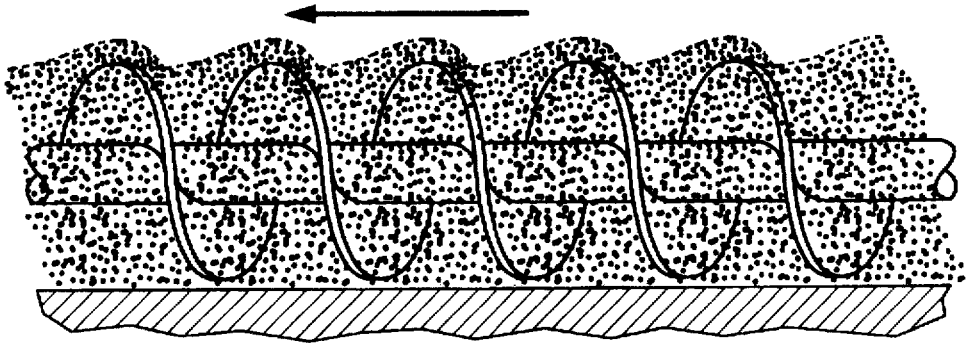
FIG. 9 PRIOR ART
FIG. 9 is an illustration of a prior art Auger in operation.

Referring to FIG. 9, which illustrates an auger with a blade with a smooth edged. When the auger rotates the helix/screw thread of the blades pushes the developer mixture axially along the auger shaft in the direction of the arrow. As the helix advances the developer height is increased at the leading/pushing face and decreased at the trailing face of the auger blade. Thus the developer mixture moves in periodic waves and is presented to the magnetic roll with localized periodic variations in the distance between the magnets and the magnetic developer mixture. These variations translate into periodic variations in the characteristics of the magnetic roll developer blanket, donor roll toner layer, and the printed image. The variations in the printed image appear as periodic diagonal bands of differential image density or darkness at a spacing that corresponds to the auger pitch distance.

Applicants have found that auger mark print defects which are periodic diagonal bands of differential image density or darkness at a spacing that corresponds to the auger pitch distance can be eliminated by incorporating two improvements into the auger design: irregular auger blade edges and wedge shape ribs/paddles 210 placed between the auger blades. Both of these improvements disrupt a periodic variation(wave) in the developer mixture flow therefore reducing auger marks. Each of them could potentially be a stand alone solution. However, a joint optimization yields an auger design which eliminates the auger mark print defect without side effects such as torque increase, flow rate decrease, or part cost increase.

Figure 10:
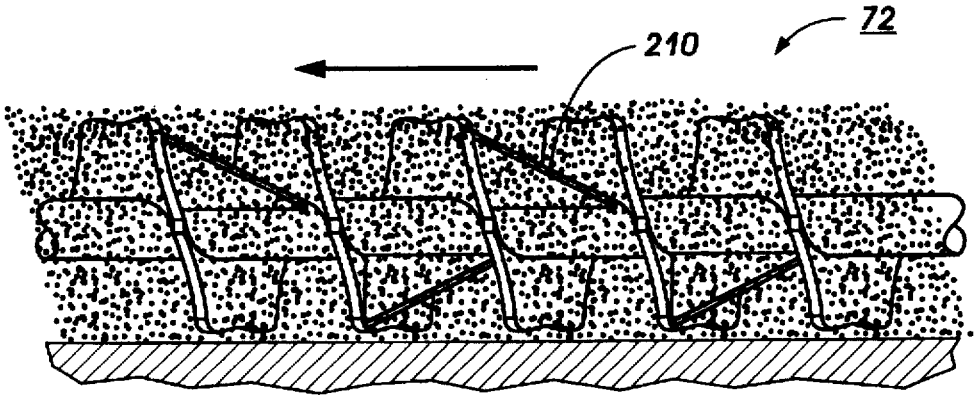
FIG. 10 is an illustration of the Auger of the present invention in operation.

Referring to FIG. 10, the irregular blade edge of the present invention in operation makes the auger "leaky" or less efficient—the developer mixture is allowed to partially slip over or flow through the auger blades. Presented here are three of the most effective designs of irregular blade edges: polygon shape(a triangle, square, or hexagon), sprocket shape(similar to a gear tooth pattern), and turbo shape(a series of small rotated tabs or flaps) as illustrated in FIGS. 3–8.

The wedge shape ribs/paddles between the auger blades force some of the developer mixture to move radially and away from the auger shaft. The wedges are positioned such that the high side is adjacent to the leading face of the blade as it is more effective to disturb the peak of the developer wave rather than the valley. The ribs/paddles are also indexed around the auger so that no vibration results from several wedges simultaneously slapping the developer mixture as the auger rotates. The ribs/paddles are placed 1.0 to 2.5 revolution from each other but preferably between 1.5 to 2.0 revolution.

While the invention has been described with reference to the structure disclosed, it is not confined to the specific details set forth, but is intended to cover such modifications or changes as may come within the scope of the following claims.

What is claimed is:

1. An auger for a development system wherein developer material is supplied to a rotating magnetic brush roll, the system comprising:

a supply auger having a length at least as great as said magnetic brush roll, said auger positioned along a horizontal plane and adapted to transport developer material in a direction so as to supply said material to said magnetic brush roll, said auger having a first portion thereof having an irregular blade edge and a second portion thereof having a substantially smooth blade edge.

2. The system of claim 1, wherein said irregular blade edge has a polygon shape.

3. The system of claim 1, wherein said irregular blade edge has a sprocket shape.

4. The system of claim 1, wherein said irregular blade edge has a turbo shape.

5. An auger for a development system wherein developer material is supplied to a rotating magnetic brush roll, the system comprising:

a supply auger having a length at least as great as said magnetic brush roll, said auger positioned along a horizontal plane and adapted to transport developer material in a direction so as to supply said material to said magnetic brush roll, said auger having a first portion thereof having an irregular blade edge; and a paddle between adjacent auger blades.

6. The system of claim 5, wherein said paddles are wedge shaped and the length of said paddles extended between adjacent auger blades.

7. The system of claim 5 wherein said paddles are positioned between 1.0 to 2.5 revolutions from each other.

* * * * *